United States Patent [19]

Berg et al.

[11] Patent Number: 4,929,110

[45] Date of Patent: May 29, 1990

[54] SPORTS BOARD

[76] Inventors: Larry Berg, 578 Sage Crescent, Sherwood Park, Alberta, Canada, T8A 0N1; Ricky A. Wright, 6009 Spruce Drive, Stettler, Alberta, Canada, T0C 2L0; Philip A. Caswell, 11831 - 135 Street, Edmonton, Alberta, Canada, T5L 1W7

[21] Appl. No.: 291,860

[22] Filed: Dec. 29, 1988

[51] Int. Cl.[5] ..... B42F 13/12; B42F 13/14

[52] U.S. Cl. ..... 402/73; 402/80 R; 402/502; 281/45; 281/51

[58] Field of Search ..... 281/42, 45, 51; 402/70, 402/71, 72, 73, 80 R, 80 P, 502

[56] References Cited

U.S. PATENT DOCUMENTS 3,620,498 11/1971 Tunkl ..... 281/51 X 4,603,883 8/1986 Barbieri et al. ..... 281/45

4,605,246 8/1986 Haas et al. ..... 281/45 X 4,687,229 8/1987 Penniman ..... 281/45 X

*Primary Examiner*—Paul A. Bell

*Attorney, Agent, or Firm*—Spensley Horn Jubas & Lubitz

[57] ABSTRACT

A sports record board composed of: two board parts having substantially rectangular writing surfaces of substantially the same shape and size, with each writing surface having two longer parallel sides and two shorter parallel sides, a flexible hinge connecting the board parts together along adjacent, equal length sides of the two writing surfaces and providing sufficient movement for either the writing surfaces or the rear surfaces of the board parts, at least one writing sheet adapted to be positioned on at least one of the writing surfaces, and an attachment device for retaining the writing sheet on the writing surface.

20 Claims, 8 Drawing Sheets

SPORTS BOARD

This invention is concerned with methods and means to record statistical and other data concerned with the playing and organization of various sports.

For many organized sports, such as soccer, football, rugby, ice hockey, field hockey, volleyball, and basketball, it is extremely useful for coaches and trainers to have available various pieces of information, often of a statistical or quasi-statistical nature, concerning the game of choice. The information of use is in various forms, and will differ from sport to sport: a typical and broadly common example is the strategy adopted by a given team for what are called "set-piece plays". All organized game teams develop and use such strategies, frequently having some choice between several for a given situation. It is highly desirable for the two team coaches to be able to record the strategy adopted by the team controlling the situation, to record the strategy adopted by the other team to contain the situation, and the final outcome. Although such situations are amenable to filming, particularly by video camera techniques, this is only a partial solution. In a sense all that a video camera will do is to preserve the raw information from which the statistical data can be developed. A paper or written record is very desirable and usually prepared, eventually, by coaches and others involved with organized sports.

One partial solution to this problem, which still is to be seen beside sports fields, is the venerable chalk board. Whilst quick and simple to use, this does not provide a permanent or portable record.

Another solution which has been adopted is to use an ordinary clip-board. Again, although this method does provide the required permanent record and is portable, this method has its disadvantages. The first is that it will only hold one page of data available for viewing at a time. This is a significant handicap if it is desired to record both teams' activities simultaneously by using two copies of the same pre-printed form. Using two clip-boards is not a viable solution, as it entails switching continuously, rapidly, and to no prearrangeable pattern between them. This exposes the sheets in use to considerable risk of defacement. Whilst a double clipboard could be used, it too has disadvantages, especially the simple bulk of the double clip mechanisms: these prevent the unit from folding down reasonably flat.

A further major disadvantage with the clipboard method is that the record sheet is held essentially at one portion of one edge. Outdoors this will allow the sheets to blow about if there is any wind. Indoors, as well as outdoors, this leaves three edges of the sheet to catch in things such as sleeve cuffs, again leading to sheet damage and defacement.

There is thus a need for a recording means which will fold flat for storage and transport, will provide smooth writing surfaces onto which more than one record sheet can be placed, and which will retain those sheets along a sufficiently large portion of their periphery to minimize corner curling and other damage.

This invention fulfils that need by providing such a board means with which suitably designed record sheets can be used.

Thus in its broadest aspect this invention provides a record board comprising in combination:

a first surface adapted to be written upon which is of a substantially rectangular shape, having two longer parallel sides, and two shorter parallel sides;

a second writing surface adapted to be written upon which is of substantially the same shape and size as the first writing surface;

a flexible hinge means connecting the first and second writing surfaces together along adjacent sides thereof, the connected sides of the first and second surfaces being of the same length, wherein the hinge means provides sufficient movement for either the writing faces or the rear faces of the first and second surfaces to be placed together; and at least one paper or other writing sheet adapted to be positioned on each or either writing surface and retained thereon by attachment means;

wherein the attachment means comprises in combination:

a line of regularly spaced holes proximate two parallel edges of each surface;

each line comprising alternately holes of a first and a second diameter, the second diameter being larger than the first diameter;

male peg means inserted into each first diameter hole to provide an upstanding portion of a diameter smaller than the second diameter, and adapted to retain the writing sheet or sheets by engagement into matching holes provided therein;

holes provided in the writing sheet or sheets corresponding to and contiguous with the second diameter holes, of substantially the same size as the second diameter holes;

and wherein the lines of holes are placed in each writing surface so that when the two writing surfaces are closed together the upstanding portions of the male pegs on one writing surface enter into the second diameter holes in the other surface releasably thus permitting the two writing surfaces to be closed together.

Preferably, the writing surfaces are joined together by a continuous hinge means.

Preferably, the hinge means is attached to a longer side of each of the surfaces, and the paper attachment holes and male pegs are in a line proximate the shorter side of each surface.

In a particularly preferred embodiment, each writing surface is attached to a backing board means; each backing board is connected by a continuous hinge means, adjacent a long side of the writing surface; and the paper attachment holes and male pegs are in a line proximate the shorter side of each surface.

It is also preferred that a female peg, with no upstanding portion and adapted to receive the upstanding portion of the male peg, be inserted into the second diameter holes thereby both to protect the holes from edge damage, and to provide more positive registration of the two surfaces when closed together.

The invention will now be described by way of reference to the attached drawings in which:-

In these figures, like parts are identified by the same numerals in each case.

Figure 1:
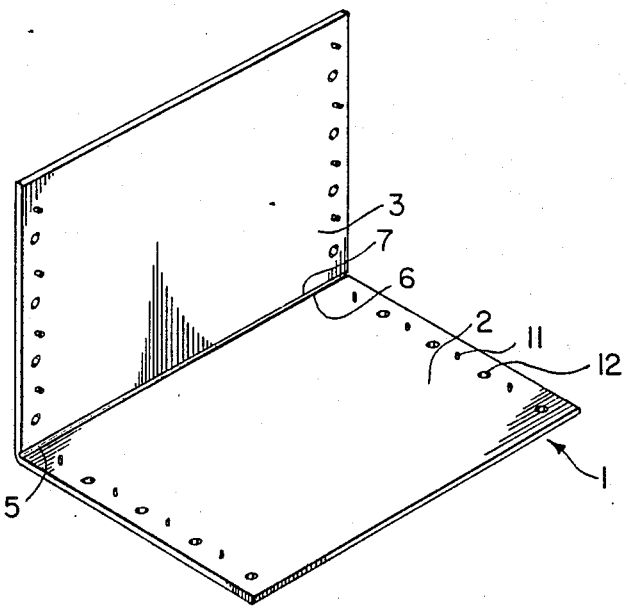
FIG. 1 shows a perspective view of a preferred embodiment.
Figure 2:
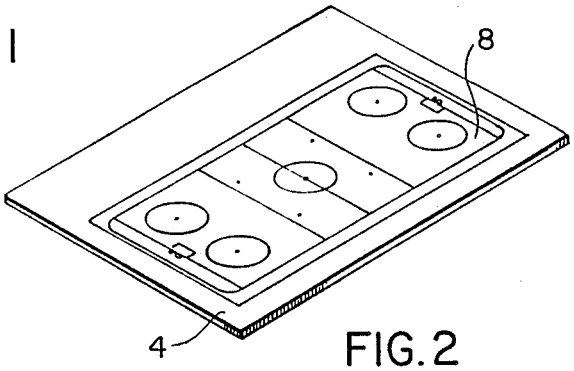
FIG. 2 shows the outside face of the first surface, with the record board in the closed position.
Figure 3:
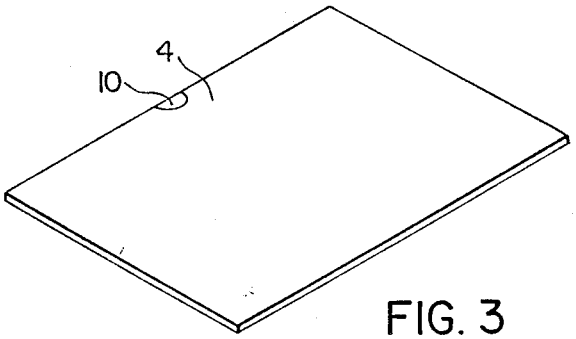
FIG. 3 shows the outside face of the second surface, with the record board in the closed position.

The overall construction of the record board can be seen from FIGS. 1, 2 and 3, which show the board open (FIG. 1) and closed (FIGS. 2 and 3). The board shown generally at 1, comprises first and second writing surfaces, 2 and 3, attached to a fabric covered outer backing, shown generally at 4, the backing including a full length hinge, 5, between two long edges, 6 and 7, of the writing surfaces. Conveniently, the writing surfaces 2, 3 are made of polystyrene, of about 5 mm thickness, which is then attached to the fabric covered backing 4. On its outer side, the fabric backing can also carry a dry-erase display panel, 8, in this instance showing the rink markings for ice-hockey, on one side (it is shown on the first surface, but could equally be on the other side). On the other outer face it is convenient to provide a slip pocket, with a thumb-access gap 10, in which spare or used paper sheets can be stored. The two writing surfaces 2,3 are also provided with two rows of holes containing male and female pegs located at 11 and 12 respectively.

Figure 5:
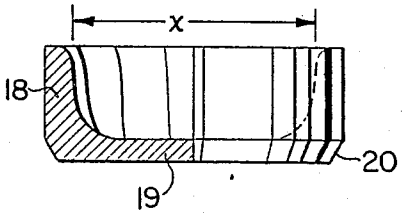
FIG. 5 shows a female peg.
Figure 4:
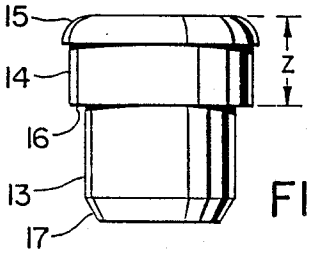
FIG. 4 shows a male peg.

The pegs, their location, and the manner in which the paper sheets are retained are shown in more detail in FIGS. 4, 5, 6 and 7. In FIG. 4 is shown a male peg, which can be seen to comprise a shank 13, a boss 14 and a cap 15. The overhanging lip of the cap 15 serves to retain the paper (as is discussed in detail below), and the surface 16 of the boss 14 serves to limit insertion of the boss into the writing surface. The end of the shank is conveniently tapered, as shown at 17, to assist with insertion of the peg. In FIG. 5 is shown a female peg, partly cut away to show internal detail. The peg has a side wall 18 and a base 19 and also is conveniently tapered, as at 20. The peg is also dimensioned so that the inner diameter x is a little larger than that of the cap 15, and the inner depth y is a little greater than the combined height z of the boss 14 and cap 15. These dimensions ensure that the boss and cap of the male peg will fit loosely and removably into the female peg. The female peg is pressed in to be flush with the face of the writing surface.

Figure 6:
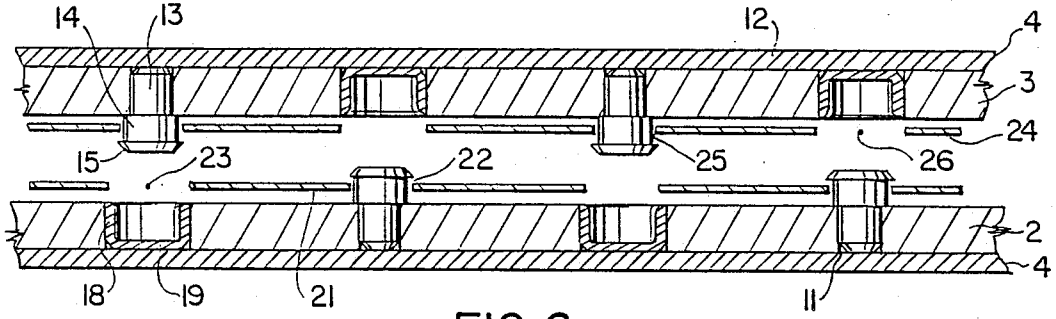
FIG. 6 shows the registration between the peg pairs.

The relationship between the male and female pegs, the paper sheets, and the writing sheets can be seen in FIG. 6, which shows in cross section along one line of pegs, the two surfaces in a nearly closed position. This Figure also shows two sheets of paper 21,24 attached to each row of pegs. Each sheet is provided with smaller holes 22,25 which are a close fit over the caps 15: the caps thus serve to retain the paper sheets. Each sheet is also provided with larger holes 23, 26 which are larger than the caps 15, thus permitting the male pegs to register loosely and snugly into the female pegs. As shown in these figures, the male and female pegs have a smooth exterior, being a push fit into surfaces 2,3. If deemed desirable retaining ribs can also be provided on either or both of the male and female pegs. These figures also show that the holes into which the male and female pegs are inserted go right through the surfaces 2,3. The holes can then be either punched or molded into the surfaces. However if desired blind holes could be used. In this embodiment, the holes are closed off by the backing members.

It can also be seen from FIG. 6 particularly that the female pegs 12 are not strictly necessary. If the surfaces 2,3 comprise relatively hard material this is so, but if the surfaces 2,3 comprise somewhat softer material, such as polystyrene, which is more convenient to write upon, then it has been found that the female pegs are desirable as otherwise the larger holes in the surfaces 2,3 can become damaged and distorted.

Figure 7:
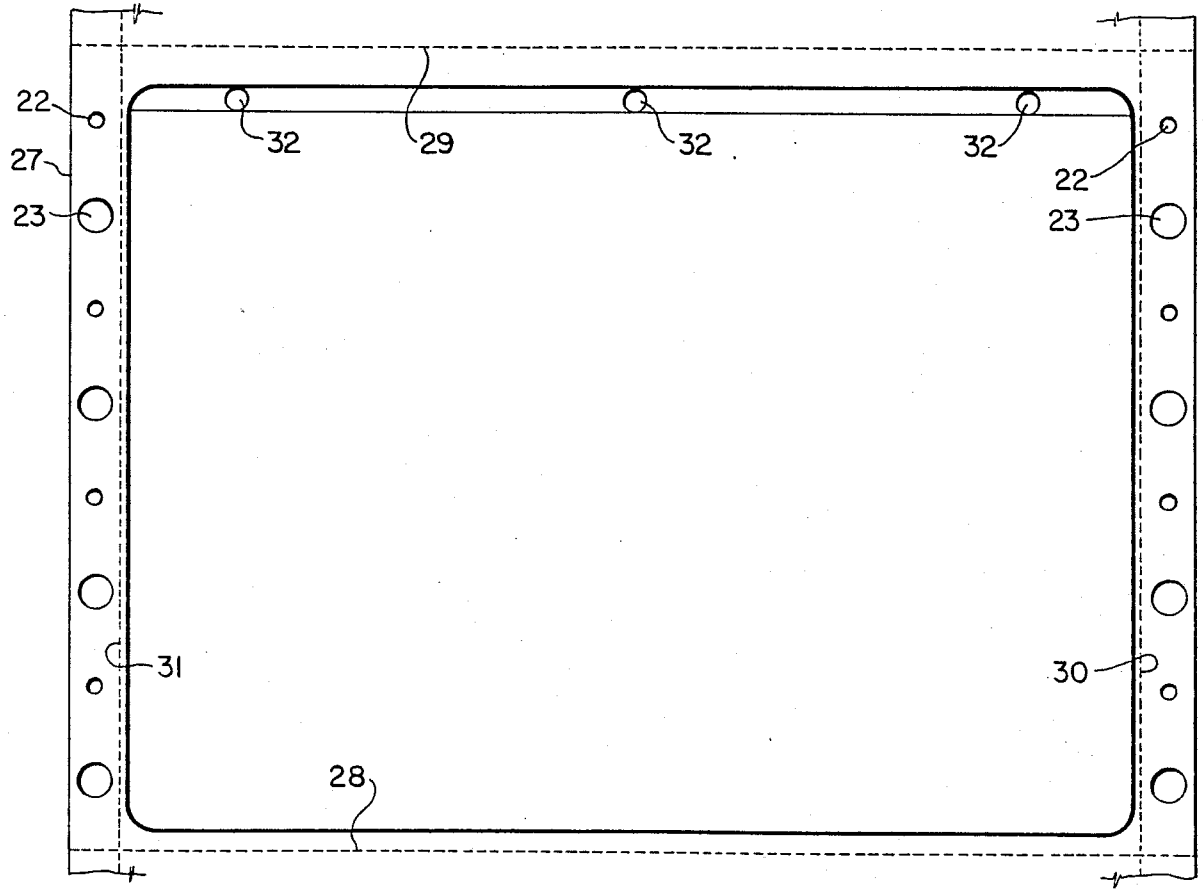
FIG. 7 shows a blank paper sheet attachable to the board writing surfaces.

A typical blank sheet for use on the surfaces 2,3 is shown in FIG. 7. The sheet shown generally at 27 conveniently can be either single sheets, or one unit on a longer roll or fan-fold of sheets. The sheet is provided with large and small holes 22,23 which are sized and placed to match the locations of the pegs, 11,12. Conveniently, perforation lines 28,29 are provided between sheets comprising a roll or a fan-fold, and are also provided to permit removal, after use, of the punched edges as at 30,31. These sheets can also be hole punched along one side, as at 32, to fit a normal ring binder for storage purposes. The paper, and the matching writing surfaces, can be of any useful size; we have found dimensions of about 30 cms by 20 cms to be convenient. With this size paper, as shown in FIG. 7, four peg holes of each size appear to be convenient. It is also to be noted that the same pegs arrangement is used in both of surfaces 2 and 3, so that the attached sheets are always oriented the same way, and can be used on either surface.

Figure 8:
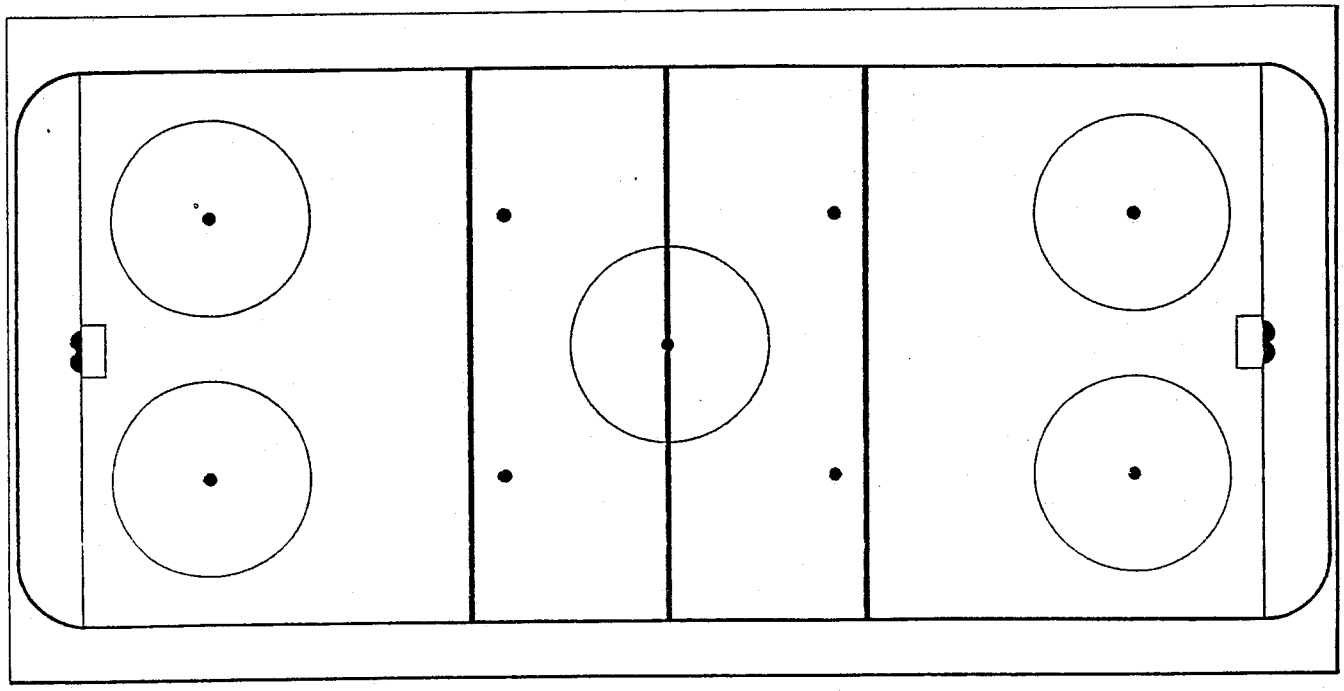
FIGS. 8, 9, 10, 11 and 12 show typical formats for use with the board system.
Figure 9:
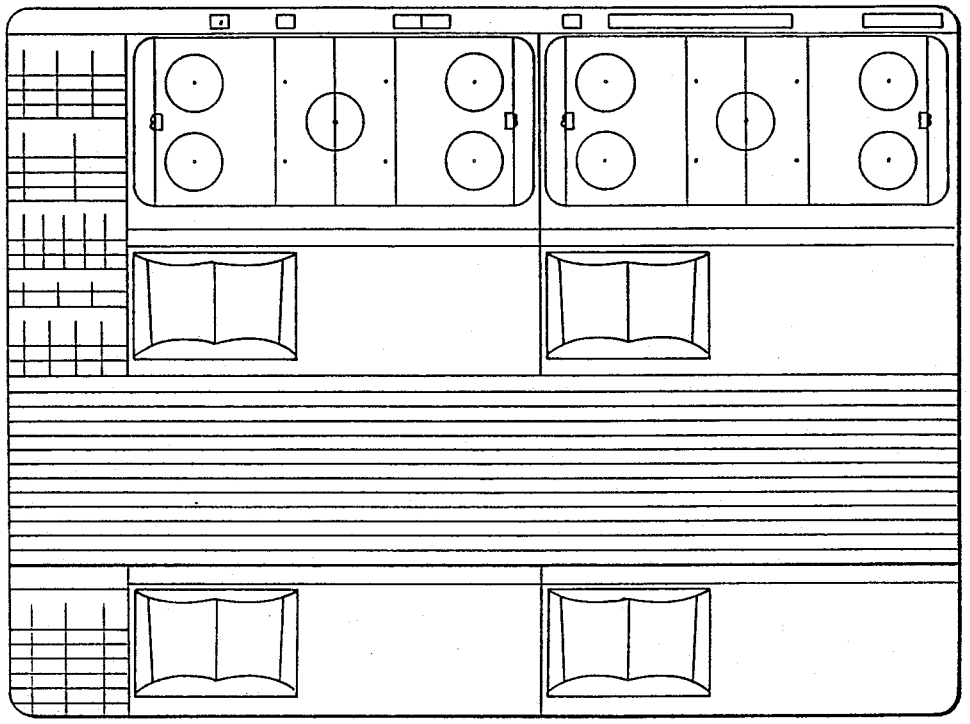
Figure 10:
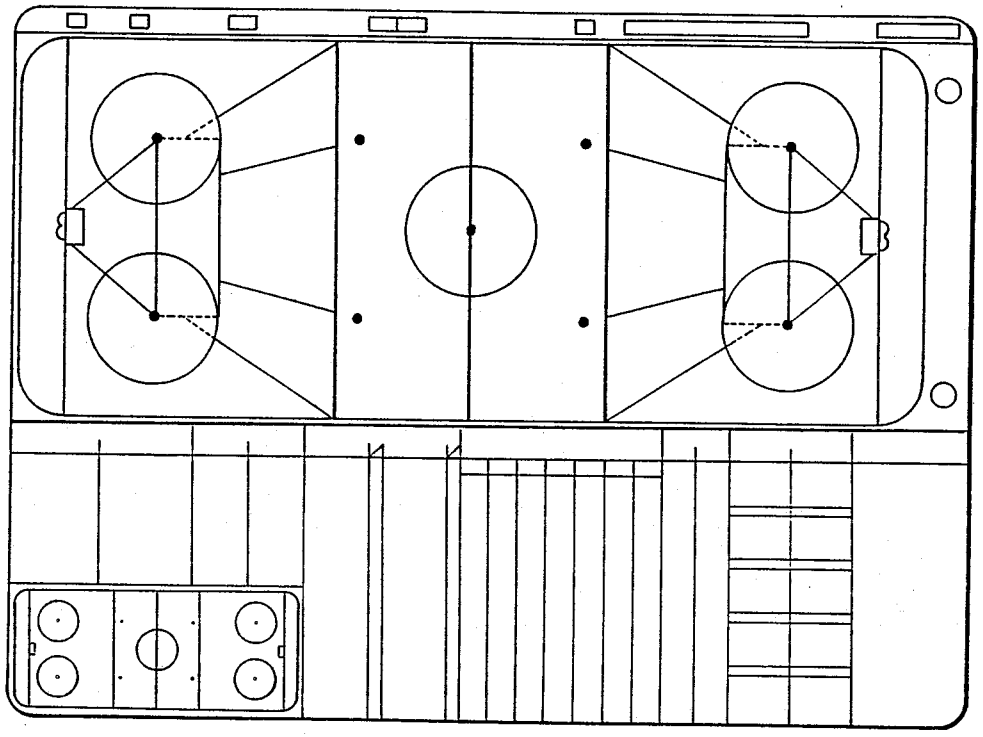
Figure 11:
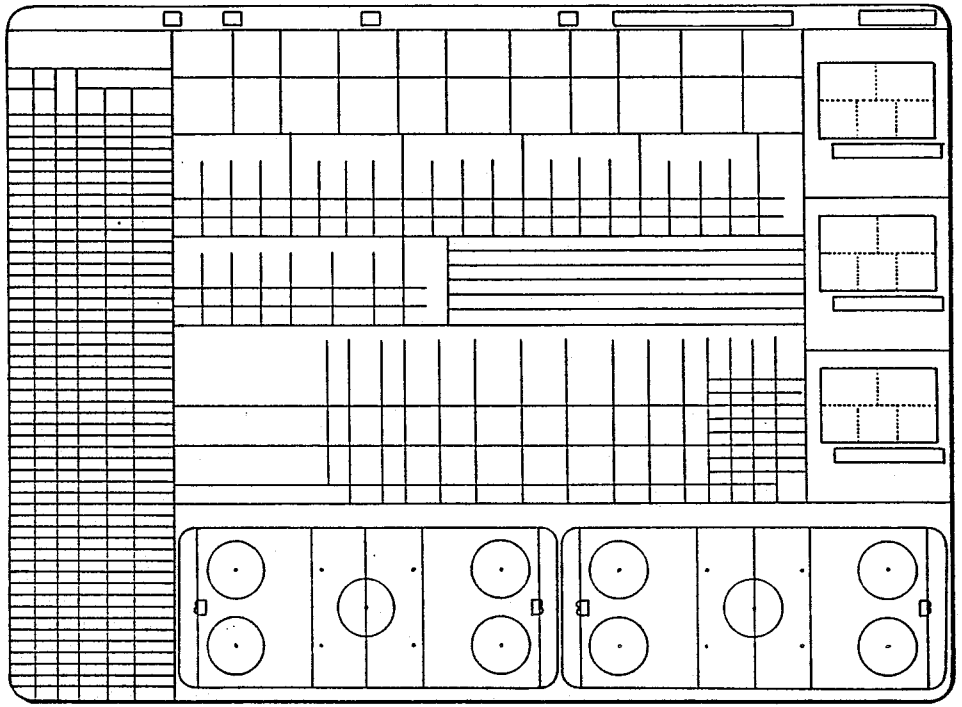
Figure 12:
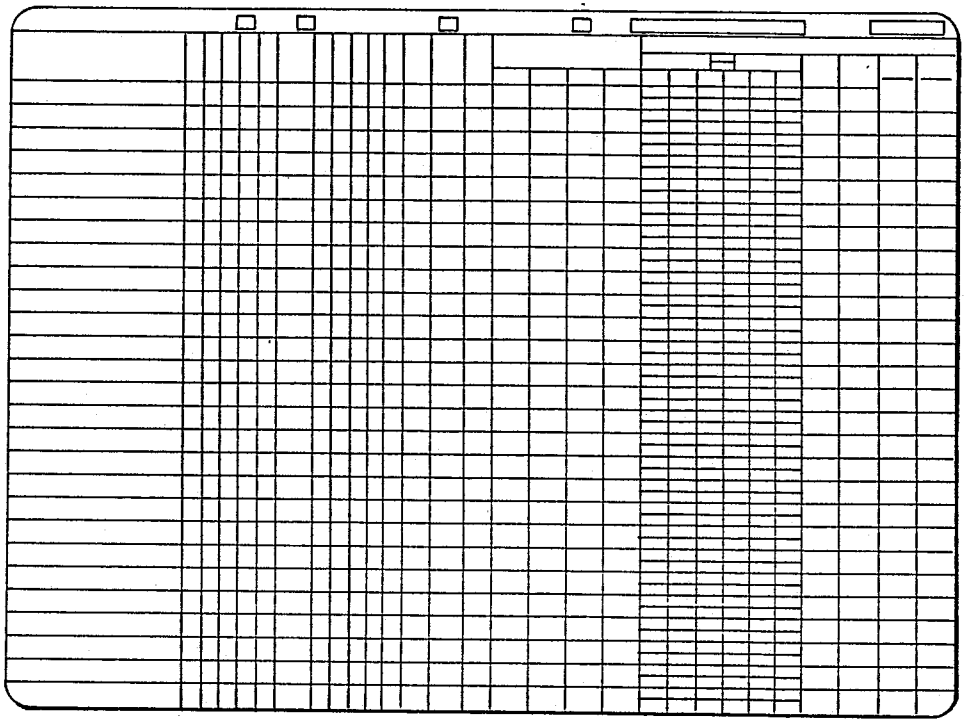

The nature of the information to be portrayed both on the dry erase panel 8 and sheets to be used with the board can vary over a very wide range, and will be determined by the sport chosen. For use with the sport of ice hockey, possible formats are shown in FIGS. 8 through 12. FIG. 8 shows a typical format for the dry-erase panel 8, comprising a stylized lay out for an ice-hockey rink. FIG. 9 shows a typical format for recording scores, goal shot placements, and team rosters. FIG. 10 shows an alternative approach to FIG. 9 for various on-ice events, as also does FIG. 11. FIG. 12 shows a basic long term record keeping sheet. From these five figures it can clearly be seen that the choice of data which can be collected and collated is very broad, and will be determined by the sport chosen. Similar sheets can be developed to cover almost any sport, especially team sports involving set-piece situations.

It is noted above that the two writing surfaces are joined by a hinge 5. This hinge should be capable of maintaining the two writing surfaces in lateral alignment in the sense that one surface is not laterally displaced relative to the other. The hinge should also be capable of movement through essentially a full circle, from a closed position in which the two writing surfaces are face to face (as in FIGS. 2 and 3), through an angled position (as in FIG. 1) to a position in which the two writing surfaces are in a back-to-back configuration.

Various modifications can be made in this basic arrangement. For example, a dry-erase panel can be provided on both covers and the pocket omitted, and the surfaces 2,3 could be provided with permanent outline markings which can be seen through the paper to be used, this eliminating some of the printing which would otherwise be required. In addition to a flat pocket to hold spare paper, a further narrow pocket or pockets can be provided to hold pens, pencils, ballpoints, markers or the like. It is also contemplated that a closure could be provided, to keep the writing surfaces together in the position of FIGS. 2 and 3 when desired.

We claim:

1. A record board comprising in combination:

a first surface adapted to be written upon which is of a substantially rectangular shape, having two longer parallel sides, and two shorter parallel sides;

a second writing surface adapted to be written upon which is of substantially the same shape and size as the first writing surface;

a flexible hinge means connecting the first and second writing surfaces together along adjacent sides thereof, the connected sides of the first and second surfaces being of the same length, wherein the hinge means provides sufficient movement for either the writing faces or the rear faces of the first and second surfaces to be placed together; and at least one paper or other writing sheet adapted to be positioned on each or either writing surface and retained thereon by attachment means;

wherein the attachment means comprises in combination:

a line of regularly spaced holes proximate two parallel edges of each surface;

each line comprising alternately holes of a first and a second diameter, the second diameter being larger than the first diameter;

male peg means inserted into each first diameter hole to provide an upstanding portion of a diameter smaller than the second diameter, and adapted to retain the writing sheet or sheets by engagement into matching holes provided therein;

holes provided in the writing sheet or sheets corresponding to and contiguous with the second diameter holes, of substantially the same size as the second diameter holes;

and wherein the lines of holes are placed in each writing surface so that when the two writing surfaces are closed together the upstanding portions of the male pegs on one writing surface enter into the second diameter holes in the other surface releasably thus permitting the two writing surfaces to be closed together.

2. A record board according to claim 1 wherein the hinge means is a continuous hinge means extending substantially the full length of the connected sides.

3. A record board according to claim 1 wherein the hinge means is attached to two longer sides of each of the writing surfaces.

4. A record board according to claim 1 wherein the hinge means is attached to two longer sides of each of the writing surfaces, and the paper attachment holes and male pegs are in a line proximate each of the shorter sides of both of the writing surfaces.

5. A record board according to claim 1 wherein the writing sheet is a paper sheet.

6. A record board as claimed in claim 5 wherein the paper sheet has printed indicia thereon pertinent to a particular sport.

7. A record board as claimed in claim 5 wherein the paper sheet further includes perforations proximate the first and second diameter holes adapted to permit removal of a narrow edge strip including those holes.

8. A record board as claimed in claim 5 wherein the paper sheet further includes both perforations proximate the first and second diameter holes adapted to permit removal of a narrow edge strip including those holes, and further holes proximate an edge of the sheet adapted to permit storage in a binder.

9. A record board as claimed in claim 1 wherein the holes of a second diameter are provided with a female peg means having an internal blind hole of such diameter and depth that when the two writing surfaces are closed together the upstanding portions of the male pegs in one writing surface enter into the blind holes in the female pegs in the other writing surface releasably thus permitting the two writing surfaces to be closed together.

10. A record board comprising in combination:

a first surface adapted to be written upon which is of a substantially rectangular shape, having two longer parallel sides and two shorter parallel sides and which is attached to a first backing board means of substantially the same shape and size as the first writing surface;

a second surface adapted to be written upon which is of substantially the same shape and size as the first surface, and which is attached to a second backing board means of substantially the same size as the second surface;

a flexible hinge means connecting the first and second backing board means together, the connected sides of the backing board means being of the same length, wherein the hinge means provides sufficient movement for either the writing surfaces or the outer faces of the backing board means to be placed together; and at least one paper or other writing sheet adapted to be positioned on each or either writing surface and retained thereon by attachment means;

wherein the attachment means comprises in combination:

a line of regularly spaced holes each proximate two parallel edges of each surface;

each line comprising alternately holes of a first and a second diameter, the second diameter being larger than the first diameter;

male peg means inserted into each first diameter hole to provide an upstanding portion of a diameter smaller than the second diameter, and adapted to retain the writing sheet or sheets by engagement into matching holes provided therein;

holes provided in the writing sheet or sheets corresponding to and contiguous with the second diameter holes, of substantially the same size as the second diameter holes;

and wherein the lines of holes are placed in each writing surface so that when the two writing surfaces are closed together the upstanding portions of the male pegs on one writing surface enter into the second diameter holes in the other surface releasably thus permitting the two writing surfaces to be closed together.

11. A record board according to claim 10 wherein the hinge means is a continuous hinge means extending substantially the full length of the connected sides.

12. A record board according to claim 10 wherein the hinge means is attached to two longer sides of each of the backing board means.

13. A record board according to claim 10 wherein the hinge means is attached to two longer sides of each of the backing board means, and the paper attachment holes and male pegs are in a line proximate each of the shorter sides of both of the writing surfaces.

14. A record board according to claim 10 wherein the writing sheet is a paper sheet.

15. A record board as claimed in claim 14 wherein the paper sheet has printed indicia thereon pertinent to a particular sport.

16. A record board as claimed in claim 14 wherein the paper sheet further includes perforations proximate the first and second diameter holes adapted to permit removal of a narrow edge strip including those holes.

17. A record board as claimed in claim 6 wherein the paper sheet further includes both perforations proximate the first and second diameter holes adapted to permit removal of a narrow edge strip including those holes, and further holes proximate an edge of the sheet adapted to permit storage in a binder.

18. A record board as claimed in claim 10 wherein the holes of a second diameter are provided with a female peg means having an internal blind hole of such diameter and depth that when the two writing surfaces are closed together the upstanding portions of the male pegs in one writing surface enter into the blind holes in the female pegs in the other writing surface releasably thus permitting the two writing surfaces to be closed together.

19. A record board as claimed in claim 10, wherein at least one outer surface of the backing board means includes a dry-erase panel.

20. A record board as claimed in claim 10 wherein at least one of the backing board means is provided with a slip pocket adapted to contain, or store, additional, or used, writing sheets.

* * * * *